United States Patent [19]

Konrath

[11] 3,946,716

[45] Mar. 30, 1976

[54] RPM REGULATOR FOR FUEL INJECTION PUMPS

[75] Inventor: Karl Konrath, Ludwigsburg, Germany

[73] Assignee: Robert Bosch GmbH, Stuttgart, Germany

[22] Filed: Aug. 20, 1974

[21] Appl. No.: 499,058

[30] Foreign Application Priority Data

Aug. 21, 1973 Germany ..... 2342107

[52] U.S. Cl...... 123/140 A; 123/139 AP; 123/140 R

[51] Int. Cl.[2] ..... F02D 1/04

[58] Field of Search..... 123/140 R, 140 A, 140 FG, 123/139 BD, 139 AP, 139 AD, 139 AR, 139 AB, 139 AA, 139 AF, 139 AC

[56] References Cited

UNITED STATES PATENTS 2,107,070 2/1938 Fleury ..... 123/140 R 3,638,631 2/1972 Eheim ..... 123/140 A

FOREIGN PATENTS OR APPLICATIONS 1,287,852 1/1969 Germany ..... 123/140 R 409,807 5/1934 United Kingdom ..... 123/139 AP

*Primary Examiner*—Charles J. Myhre

*Assistant Examiner*—Daniel J. O'Connor

*Attorney, Agent, or Firm*—Edwin E. Greigg

[57] ABSTRACT

A centrifugal rpm regulator for the fuel injection pump of an internal combustion engine is equipped with a separate, independent, rpm-responsive adjustment mechanism which rotates a cam. This cam serves as the limiting stop for a lever which controls the injected fuel quantity and it determines the maximum injected fuel quantity. The cam is linked to a plunger which is actuated by rpm-dependent fluid pressure. Axial motion of the plunger results in rotation of the cam. The cam is mounted on a pin which is affixed eccentrically and adjustably within the regulator housing.

7 Claims, 1 Drawing Figure

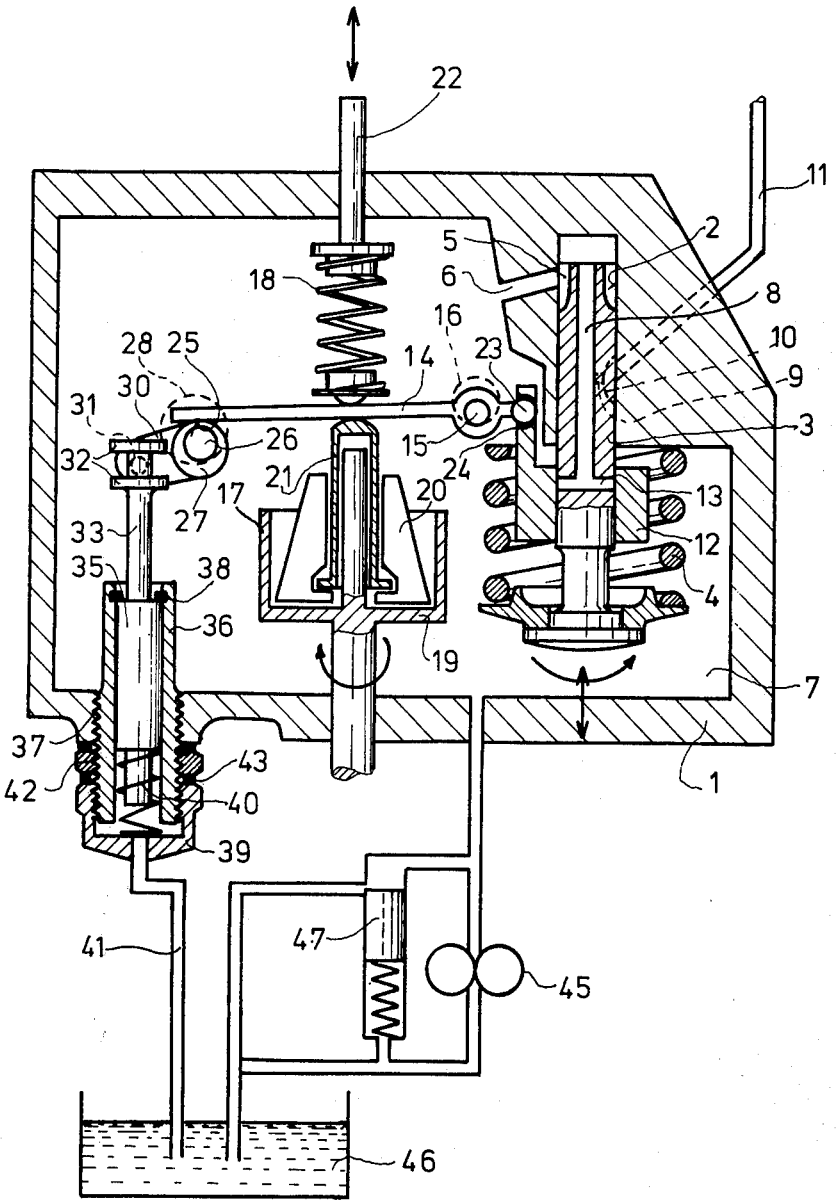
22
11
2
5
6
8
18
16
10
28
25
14
23
9
30
31
26
15
3
32
21
24
17
20
13
27
33
12
35
38
4
36
19
7
37
43
42
40
1
39
41
47
45
46

RPM REGULATOR FOR FUEL INJECTION PUMPS

BACKGROUND OF THE INVENTION

The invention relates to an rpm regulator for fuel injection pumps for use in internal combustion engines of the type which includes at least one intermediate control lever, one arm of which is engaged by a primary rpm-dependent governor mechanism acting in opposition to the arbitrarily variable force of a regulator spring and whose other arm is coupled to the fuel quantity setting member of the fuel injection pump. A stop, which is adjustable against the force of a spring by rpm-dependent means, limits the path of the fuel quantity setting member in the direction of increasing the delivered fuel quantity and determines the maximum fuel quantity supplied to the engine. The rpm-dependent means which sets the stop is actuated by control fluid whose pressure increases with increasing rpm and the adjustment of the stop is independent of the state of the primary rpm-dependent governor mechanism.

In the known rpm regulator of this type, the rpm-dependent fuel pump pressure sets a plunger provided with a cam plate against the force of an adapter spring, and one arm of a bell crank lever serves as a stop for the above mentioned intermediate lever, whereas the other arm of the bell crank lever follows the track of the cam plate. The construction of such a cam plate is relatively expensive however, and, furthermore, the bell crank lever and the control spring cause relatively high forces to be transmitted to the plunger.

As examples of known prior art devices owned by the assignee of this application, see Eheim, U.S. Pat. No. 3,635,603, issued Jan. 18, 1972 and also Eheim, U.S. Pat. No. 3,638,631, issued Feb. 1, 1972.

OBJECT AND SUMMARY OF THE INVENTION

It is an object of the present invention to provide an rpm regulator for fuel injection pumps which does not have the above mentioned disadvantages and to construct it with simpler means than has heretofore been possible.

It is another object of the invention to provide a regulator in which the rpm-dependently controlled adaptation process takes place independently of the primary rpm regulation of the engine.

This object is achieved, according to the invention, by providing a cam which functions as a stop that can be rotated by an actuating crank coupled to a plunger. The plunger is acted upon by control fluid and against the force of at least one spring. In order to adjust the basic setting of the cam with which it becomes effective at a particular rpm and to adjust the setting beyond which no further change occurs, a preferred characteristic of the invention is that the initial and final positions of the plunger can be changed by at least one adjustable stop.

Another feature of the invention is that the pivotal axis of the cam and the pivotal axis of the intermediate control lever are changeable by means of eccentrically located, adjustable pivot pins. This feature provides another method for adjusting the basic setting of the cam.

A particularly favorable characteristic of the invention provides that the cam is an eccentrically positioned bolt. This provision makes possible an adjustment of the stop such that the full load fuel quantity can either increase or decrease with increasing rpm, depending on the initial, basic position of the eccentric bolt. This adjustment mechanism can be produced very simply.

The invention will be better understood as well as further objects and advantages will become more apparent from the ensuing detailed specification of a preferred, although exemplary embodiment of the invention taken in conjunction with the drawing.

BRIEF DESCRIPTION OF THE DRAWING

The single FIGURE of the drawing is a front elevational, partially sectional diagram of the rpm regulator according to the invention.

DESCRIPTION OF THE PREFERRED EMBODIMENT

A housing 1 (partially shown) of a fuel injection pump includes a bore 2 containing a pump piston 3 which is driven in simultaneously rotating and axial motion by means which are not shown, and in opposition to the force of a return spring 4. The working chamber of this pump is supplied with fuel flowing from a suction chamber 7 through a bore 6 within housing 1 and thence through a longitudinal groove 5 within the outer surface of the pump piston. Delivery of fuel to the working chamber of the pump takes place while the pump piston executes its suction stroke or while it occupies its bottom dead center position. When the piston has executed a certain part of its pressure stroke and after an appropriate rotation of the pump piston, the bore 6 is closed and the fuel remaining in the pump working chamber is delivered through an axial channel 8 extending within the pump piston, through a radial bore 9 and through a longitudinal distribution groove 10, located in the surface of the pump piston, to one of several pressure lines 11, whose terminations are distributed about the circumference of the bore 2, and each of which leads to a cylinder of the internal combustion engine (not shown).

Sliding on and coaxially with the pump piston 3 is a control sleeve 12 which controls the opening of a radial bore 13 connected to the axial channel 8 and thus determines the quantity of fuel delivered during the pressure stroke of the piston. Once the radial bore 13 has been opened, fuel flows out into the suction chamber 7.

The control sleeve 12 is moved by an intermediate control lever 14 which is pivotable about a pin 15 eccentrically mounted on a shaft 16 held in the housing 1. Thus, when the shaft 16 is rotated, the location of the pin 15 is changed. The lever 14 is engaged by a centrifugal mechanism 17 which serves as the rpm-dependent governor mechanism and operates against the force of a regulator spring 18. The carrier 19 for the flyweights 20 of the centrifugal mechanism is driven at the rpm of the pump. The centrifugal force causes the excursion of flyweights 20 which push a sleeve 21 engaging the lever 14. This motion is opposed by the force of the regulator spring 18 whose precompression can be arbitrarily changed by a rod 22 and which is positioned between that rod 22 and the lever 14.

One end of lever 14 is equipped with a spherical head 23 which engages a complementary cavity 24 for the purpose of shifting the control sleeve 12. The farther the control sleeve 12 is shifted upwardly, the greater is the fuel quantity delivered by the injection pump, because the radial bore 13 is opened at a correspondingly later time during the pressure stroke of the pump piston and thus a larger portion of the fuel quantity within the pump working chamber is injected. This upper position of the control sleeve 12, which determines the maximum fuel quantity supplied, is determined by a stop 25 (full-load stop) for the lever 14. This full-load stop 25 is formed by a cam 27 which is rotatable about a pin 26. In the embodiment shown, this cam 27 is a bolt eccentrically mounted on the pin 26. Similar to the mounting of the lever 14 on pin 15, this pin 26 is also eccentrically disposed on a shaft 28 held in the housing 1 so that, when the shaft 28 is rotated, the location of the pin 26 may be changed.

Rotating with cam 27 is a crank 30, coupled to a further pin 31 which engages a parallel linkage 32 located adjacent to the upper end of a plunger rod 33. The plunger rod is an extension of a plunger 35 which glides within a cylindrical bushing 36 screwed into the housing 1 by means of external threads 37. The bushing 36 is open at the end which extends into the housing and is provided there with a first fixed stop 38 for limiting the motion of plunger 35. The opposite part of the cylindrical bushing 36 extends out of the housing 1 and carries a closure cap 39 that is screwed onto the external threads 37. Disposed between the closure cap 39 and the plunger 35 is a compression spring 40 which urges the plunger 35 toward the first stop 38.

The depth to which the bushing 36 is screwed into the housing 1 determines the relative position of the first fixed stop 38 with respect to the pin 26. When the desired depth is reached, the bushing may be secured in that position by a lock nut 42 which is advantageously screwed onto the end of the bushing 36 extending from the housing 1.

The cap 39 also serves as the second stop for the plunger 35 and it may be screwed onto the cylinder bushing to a depth which is changeable by the choice of an appropriate spacer disk 43 located between the lock nut 42 and the cap 39. In order that the plunger 35 may be freely displaced against the compression spring 40, the space between piston 35 and cap 39 is pressure-relieved by a leakage line 41.

The suction chamber 7 is supplied with fuel by a fuel supply pump 45 drawing fuel from a fuel container 46. The pressure within the suction chamber 7 is controlled in known manner in dependence on rpm by a pressure control valve 47 in such a way that the pressure within the suction chamber increases with increasing rpm.

This rpm-dependent pressure in the suction chamber urges the piston to move against the compression spring 40 and if, after overcoming the force of this spring, the rpm continues to increase, the plunger is displaced up to the second stop formed by the cap 39. The axial displacement of the plunger moves the pin 31 and the crank 30, rotating cam 27 which defines the position of the full load stop. Depending on the angular position of cam 27 with respect to the initial position of plunger 35, the rpm-dependent displacement of the plunger 35 may rotate the full load stop 25 either in the sense of increasing or of decreasing the maximum fuel quantity. Thus, even the simple eccentric cam 27 makes possible an adaptation of the maximum injected fuel quantity to the prevailing requirements of the internal combustion engine serviced by this fuel injection pump. Additional possibilities for adaptation are provided by appropriate choice of stops 38, 39, of the characteristics of the spring 40, of the shape of the cam and of the position of the pin 26 with respect to the rotational axis of shaft 28.

Of course, the parallel linkage 32 engaging pin 31 of crank 30 could be replaced by an elongated hole extending transversely with respect to the axis of the plunger rod. Again, the compression spring 40, which has been shown as a linear spring in the above described exemplary embodiment, could be a progressive spring or could be replaced by several springs with different force characteristics. The manner of fastening the cylindrical bushing 36 to the pump housing makes possible a very advantageous external adjustment of both stops for plunger 35.

By employing relatively simple means, the above described mechanism provides the possiblity to set the full-load fuel quantity delivered by the injection pump to the maximum amount which can still be smokelessly combusted by the internal combustion engine at different speeds, i.e., at different rpm's. Nevertheless, this mechanism does not limit the operation of the rpm-governor, and the primary regulation of engine rpm itself is not unfavorably affected.

What is claimed is:

1. In an rpm regulator for use with a fuel injection pump associated with an internal combustion engine, said regulator including a housing, rpm-dependent means, an intermediate lever, regulator spring means connected to said intermediate lever, said rpm-dependent means engaging one arm of said intermediate lever in opposition to the force of said regulator spring means causing said intermediate lever to be thereby adjusted, rpm-responsive stop means for limiting the motion of said intermediate lever, and means for supplying regulator fluid to the housing, wherein the pressure of the regulator fluid is rpm-dependent, and wherein the regulator fluid serves to interact with said rpm-responsive stop means, the improvement comprising:

a cam, affixed adjustably to said housing and engageable with said intermediate lever;

a crank, connected to said cam;

a plunger, slidably disposed with respect to said housing and connected to said crank; and a spring mounted so as to exert a force against said plunger, whereby the regulator fluid acts on said plunger in opposition to said spring, causing said plunger to turn said crank and thereby rotate said cam.

2. An improved rpm regulator as defined in claim 1, the improvement further comprising: adjustable stop means for limiting the axial motions of said plunger.

3. An improved rpm regulator as defined in claim 2, the improvement further comprising: a bushing, provided with stop means affixed thereto and with external threads, said bushing forming a cylinder within which said plunger may slide limited by said stop means, said bushing being threadedly inserted in said housing.

4. An improved rpm regulator as defined in claim 3, the improvement further comprising: a cap, for threaded engagement with that end of said bushing which protrudes from said housing.

5. An improved rpm regulator as defined in claim 4, the improvement further comprising: a lock nut, threadedly engaging said bushing; and at least one spacer disk placed on said bushing, whereby the cooperation of said at least one spacer disk and said lock nut permits the adjustment of the depth of the threaded engagement of said bushing and of said cap.

6. An improved rpm regulator as defined in claim 4, the improvement further comprising: adjustable, eccentric pins, affixed to the housing of the regulator to serve as pivots for said intermediate lever and for said cam, whereby an adjustment of the location of the pivotal axis of said intermediate lever and said cam is made possible.

7. A improved rpm regulator as defined in claim 6, wherein said cam is a bolt held adjustably and eccentrically on one of said adjustable, eccentric pins.

* * * * *